United States Patent [19]

Bechtel

[11] Patent Number: 5,042,186

[45] Date of Patent: Aug. 27, 1991

[54] EASY-ON, EASY-OFF SIGHTING AID MOUNT FOR A REVOLVER

[76] Inventor: Daniel L. Bechtel, 4701 Inwood Rd., Fort Worth, Tex. 76109

[21] Appl. No.: 562,661

[22] Filed: Aug. 3, 1990

[51] Int. Cl.[5] ..... F41G 1/35

[52] U.S. Cl. ..... 42/103; 362/110

[58] Field of Search ..... 42/103, 106; 362/110, 362/113, 114

[56] References Cited

U.S. PATENT DOCUMENTS

| | | | |
|---|---|---|---|
| 849,198 | 4/1907 | Boust | 362/114 |
| 995,867 | 6/1911 | Hegwer | 362/114 |
| 1,610,092 | 12/1926 | Hise | 362/110 |

*Primary Examiner*—Michael J. Carone

*Attorney, Agent, or Firm*—Charles W. McHugh

[57] ABSTRACT

In revolvers that are loaded by swinging or shifting the revolver's cylinder away from alignment with the barrel, an extension of the cantilevered axle pin (upon which the cylinder rotates when the revolver is fired) can be sufficiently exposed so that a specially crafted mounting device can be connected to the axle pin. Connection is accomplished by simply sliding the mounting device longitudinally over the distal end of the pin (or an extension thereof). A common extension of the cylinder's axle is an ejector rod that is used to eject spent shells from a cylinder. Typical ejector rods have both the strength and the precision that makes them well suited to function as anchors for a mounting device. When a cylinder and its axle pin are rotated back to a closed position with respect to the revolver's frame, the mounting device is captured by rigid parts of the revolver (e.g., the barrel and/or a part of the frame)—so that the device will remain fixed until the cylinder is again opened. By attaching an auxiliary sighting aid (such as a laser) to such a mounting device, the sighting aid can be reliably and repeatedly attached to a revolver without the use of any screws or nuts or other mechanical fasteners. The elapsed time that is required to slide a mounting device over the exposed end of an axle pin or ejector rod is on the order of a few seconds. Removing the mounting device and its attached sighting aid is equally fast, thereby restoring the revolver to its factory-original condition without leaving any evidence that a sighting aid was ever mounted on the gun.

17 Claims, 1 Drawing Sheet

APPROVED O.I.P.E. FIG. 1
BY
CLASS 42 SUBCLASS 103

5042186

C11

EASY-ON, EASY-OFF SIGHTING AID MOUNT FOR A REVOLVER

BACKGROUND OF THE INVENTION

This invention relates generally to techniques for attaching an auxiliary sighting aid (such as a flashlight or laser) to a handgun of the revolver type; more specifically, it relates to a technique for quickly attaching an under-the-barrel sighting aid to a revolver in which an extension of the revolver's axle (upon which the cylinder rotates) is utilized as an anchor member.

It is well known to attach to handguns auxiliary sighting aids such as small flashlights and lasers. One example of an attachment to a semi-automatic pistol is disclosed in U.S. Pat. No. 4,418,487 to Strahan entitled "Mounting Bracket For Gun Sight." Another disclosure of the same technique for using the slide-stop pin of a semi-automatic pistol is disclosed in U.S. Pat. No. 4,777,754 to Reynolds, Jr. entitled "Light Beam Assisted Aiming Of Firearms." However, both the Strahan and the Reynolds brackets require that a person to have had sufficient training and instruction in firearm disassembly to be able to field-strip a semi-automatic pistol and substitute a new, longer slide-stop pin for the original, shorter pin. An even older technique for attaching a flashlight to a pistol is revealed in U.S. Pat. No. 1,263,667 to Henderson and Neet entitled "Flashlight Attachment For Firearms." Of course, the fact that Henderson and Neet use fixed straps that extend over and around the pistol's barrel means that their mount can only be used on those semi-automatic pistols which have fixed barrels.

When the firearm is of the revolver type, no slide-stop pin is available for securing a mount to which an auxiliary sighting aid might be attached. If the owner of a revolver wishes to have an auxiliary sighting aid mounted above the revolver's barrel, an apparatus like that shown in U.S. Pat. No. 4,531,321 to Bechtel entitled "Scope-Mounting Devices For Firearms" may be rigidly connected to the revolver's strap (over the cylinder) by tightening one or more fine-pitch screws. If the auxiliary sighting aid is to be mounted under the barrel, an apparatus may be utilized which is like that shown in co-pending U.S. application Ser. No. 07/524,829 entitled "Mount For Attaching A Sighting Aid To A Pistol," filed by the same inventor as in this case. But while a construction such as that shown in application Ser. No. 524,829 is of pleasing design and is certainly sturdy enough to resist the recoil loads from firing high-velocity ammunition, it must be acknowledged that a few minutes may be required to engage and tighten the screws in order to secure such a mount to a revolver.

The advantages that have recently been made in miniaturizing lasers for firearms have now made it possible to carry a light-weight laser in a shirt pocket or in a small pouch on a belt, where the laser and its mount might be available for attachment to a revolver if and when needed. With the advent of lasers that are as compact and smooth as the one shown in co-pending application Ser. No. 07/519,296 entitled "Laser Housing For Attachment To A Hand-Held Firearm" by the instant inventor, it would be feasible for police personnel to carry their service revolvers in traditional holsters and then add a miniature laser only when the same might be needed. It is an object of this invention to provide an apparatus that permits such installation in a quick and dependable manner, without requiring the use of any screws, wrenches or other tools. More particularly, it is an object of this invention to provide an easy-on, easy-off mounting technique for mounting an auxiliary sighting aid on a revolver.

It is another object to provide a mounting arrangement in which a personally owned sighting aid (such as a laser) might be attached to a service revolver that is the property of a governmental authority, police department, or a security agency—without requiring any alteration of the revolver or causing any deterioration in its surface finish.

Still another object is to provide what may be described as an essentially instantaneous technique for mounting an auxiliary sighting aid on a revolver.

These and other objects will be more readily apparent from the detailed descriptions provided hereinafter, with appropriate reference to the several figures of the accompanying drawing.

BRIEF DESCRIPTION OF THE INVENTION

In brief, the invention described herein takes advantage of the fact that most modern revolvers are loaded by swinging or shifting the revolver's cylinder away from alignment with the barrel. When in this open or "loading" position, it has been found that an extension of the cantilevered axle pin (upon which the cylinder rotates when the revolver is fired) is sufficiently exposed that a specially crafted mounting device can be connected to the axle pin, preferably by sliding the mounting device longitudinally over the distal end of the pin. A common extension of the cylinder's axle is an ejector rod that is used to eject spent shells from a cylinder. And it has been found that typical ejector rods have both the strength and the precision that makes them well suited to function as anchors for a mounting device.

When a cylinder and its axle pin are rotated back to a closed position with respect to the revolver's frame, a special mounting device to be disclosed herein will be captured by rigid parts of the revolver (e.g., the barrel and/or a part of the frame)—so that the device will remain fixed until the cylinder is again opened. By attaching an auxiliary sighting aid (such as a laser) to such a mounting device, the sighting aid can be reliably and repeatedly attached to a revolver without the use of any screws or nuts or other mechanical fasteners. The elapsed time that is required to slide a mounting device over the exposed end of an axle pin or ejector rod is so short that the mounting process can realistically be described as almost instantaneous. For example, in one test involving a Smith & Wesson Model 65 revolver, the cylinder was opened, a specially configured mounting device was slipped over the exposed end of the ejector rod, and the cylinder was closed to its firing position—all in three seconds. Removing the mounting device and its attached sighting aid is equally fast, thereby restoring the revolver to its factory-original condition without leaving any evidence that a sighting aid was ever mounted on the gun.

DETAILED DESCRIPTION OF A PREFERRED EMBODIMENT OF THE INVENTION

Figure 1:
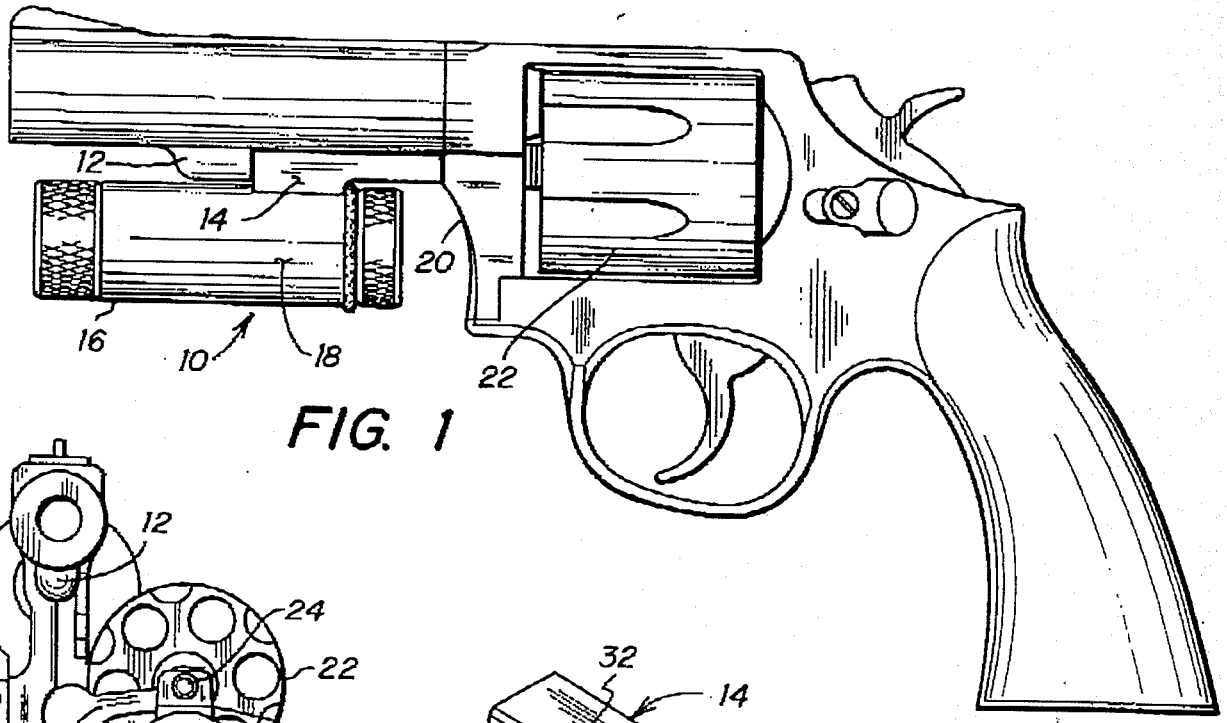
FIG. 1 is an elevational view of the left side of a revolver upon which has been mounted a specially configured housing and an auxiliary sighting aid in the form of a small laser.

Referring initially to FIG. 1, a mounting device 10 is shown installed on an exemplary revolver, which in this case is suggestive of a Smith & Wesson Model 65 revolver. Over a million similar guns have been supplied to military and police forces over the years, and many of them are still in service with police departments, security agencies, and related governmental authorities. However, it should be understood that the invention is not limited to revolvers made by a particular manufacturer; many solid-frame revolvers made by Smith & Wesson, Colt, Ruger, High Standard, etc., as well as revolvers made by many foreign manufacturers, have frames that are adapted to support a mounting apparatus of the type being disclosed herein. As long as the revolver has a cylinder axle (or extension thereof) that is exposed, or becomes exposed when the cylinder is opened, it is believed that there will be a structure to which a mounting device can be attached in accordance with this invention.

The mounting device 10 is shown mounted below the barrel and ahead of the trigger guard; it is also engaged with the revolver's ejector rod, which constitutes a longitudinal extension of the cylinder's axle. The engagement cannot be verified from this single view, because that part of the ejector rod which would normally be visible is now concealed by a housing 14 that is resting just behind the barrel lug 12. Below the housing 14 is an auxiliary sighting aid 16, in this case a cylindrical shell 18 within which is mounted a small, battery-operated laser. The shell 18 is mounted a small, battery-operated laser. The shell 18 is configured so that its longitudinal axis will be generally parallel to the bore of the revolver when the housing is in the position shown in FIG. 1, which will also be referred to herein as its first position. Other moving parts and their relative positions are: the crane 20 is essentially vertical; the cylinder 22 is centered with respect to the frame and in its closed (or firing) position; and the barrel is oriented in what will be defined as a horizontal position.

Figure 2:
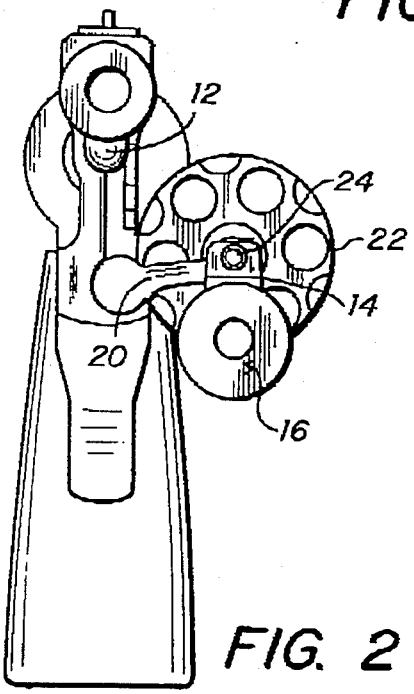
FIG. 2 is a front elevational view of the revolver shown in FIG. 1, but with the cylinder swung outward (to the left) to a loading position.

Turning next to FIG. 2, the cylinder latch has been unlocked and the cylinder 22 has been swung open to its second or loading position. The crane 20 is now nearly horizontal, and the housing 14 and its associated shell 18 have rotated slightly about the ejector rod 24. It will be seen that in this second position for the housing 14 the barrel lug 12 no longer serves to block the housing and hold it in place on the revolver. Hence, with the cylinder 22 swung to this open position, the housing 14 could be simply pulled forward until it slides longitudinally off the cantilevered ejector rod 24 and becomes separated from the revolver.

Figure 3:
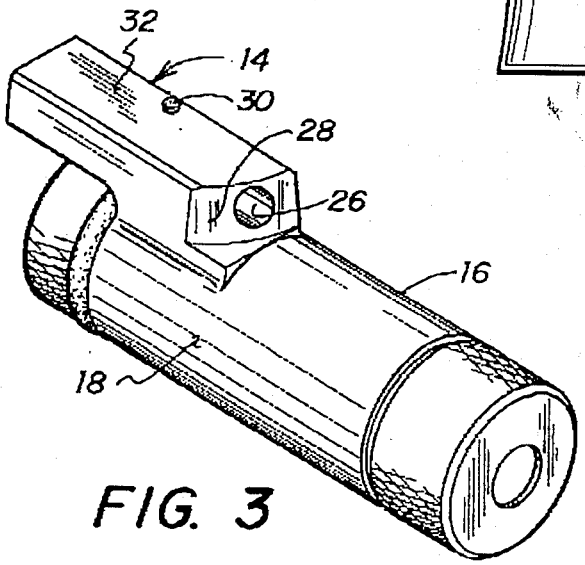
FIG. 3 is a perspective view of a mounting apparatus in accordance with this invention, drawn at a different scale than the apparatus as shown in FIG. 1.

Referring next to FIG. 3, the housing 14 is shown at a different scale in order to better illustrate its features, as well as its relationship to the associated sighting aid. Shown in the upper part of this figure is the rigid housing 14 which is provided with a longitudinal bore 26 that is sized and oriented to effect a slip fit with the revolver's ejector rod. That is, depending upon the particular revolver for which the housing is to be fitted, the bore 26 will probably be made with a diameter that is a couple of thousandths of an inch greater than the outer diameter of the ejector rod. The length of the housing 14 is established so that it will fit snugly within the gap between the front of the frame and the barrel lug. To facilitate correctly positioning the housing 14 as the crane is swung upward and the cylinder is closed, the leading face of the housing (identified by the numeral 28) is preferably slanted in such a way as to create a cam or ramp-like member. By tilting the revolver slightly upward, and with the housing 14 surrounding the ejector rod, gravity will probably help the housing to slide downward along the ejector rod before the cylinder is closed; this will help to ensure that the frontal surface 28 (rather than a side of housing 14) will make initial contact with the rear of barrel lug 12 when the cylinder is being closed. If there is too much resistance to free axial sliding of the housing 14, it may simply be pulled down manually (in a telescopic manner) over the ejector rod. Continued inward pressure on the cylinder 22 as it is being closed will then "cam" the housing 14 rearwardly until the rear face of the housing comes to rest against the crane 20 or some other part of the revolver, e.g., the frame's front surface.

Figure 5:
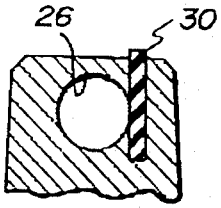
FIG. 5 is a fragmentary cross-sectional view of the top part of the mounting apparatus, taken in a plane that passes transversely through a resilient plug that lies vertically in the mount housing.

To promote a tight fit of the housing 14 as it is being installed on a revolver, and to accommodate fluctuations due to wear or possible variations in manufacturing tolerances, it is preferred that the rigid housing 14 be made just slightly undersize. Then, any gaps that may exist between the housing 14 and parts of the revolver are bridged with spring-biased members or rubber bumpers or equivalent resilient pads. To this end, there is provided in housing 14 a vertically drilled hole which is subsequently filled with a rubber-like body 30 having significant resilience. A suitable material for the body 30 is the cord from which O-rings are sometimes made, and having a diameter of about $\frac{1}{8}$ to $\frac{1}{4}$ inch. Referring additionally to FIG. 5, such a rubber-like body 30 is shown in the fragmentary view of the top of housing 14. By the judicious sizing and placement of this cord 30 during manufacture of the housing, the cord can serve two purposes. First, it protrudes above the top surface 32 for a few thousandths of an inch to serve as a cushion against the lower surface of the barrel. Second, it protrudes into the bore 26 for a few thousandths of an inch, serving as a resistance pad (or brake) to prevent the housing 14 from accidentally slipping off the end of an open ejector rod, if the revolver should be inadvertently pointed downward during installation. Of course, the hardness of the body 30 as well as its size will have an impact on these properties; but the body has been deliberately designed to foster removal and substitution of another material if the original should be found to be too hard or too soft.

A similar resilient body 34 is inserted into the housing 14 in a horizontally drilled hole, so that it will protrude out of the back of the housing and make contact with a vertical surface of the revolver. As they leave the factory, these resilient bodies 30, 34 may protrude outwardly for, say, 0.030 inch. The person who is installing a given device on his or her revolver may then trim off any excess with a razor blade until just the right amount of cushioning material is left on the housing 14.

Figure 4:
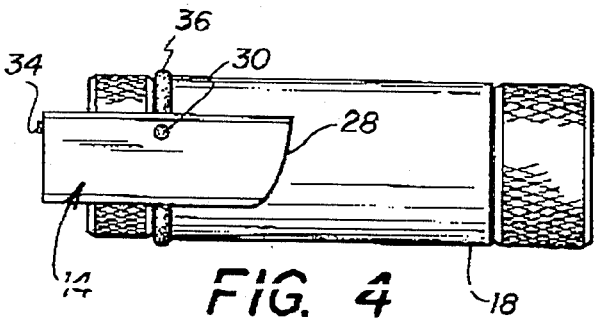
FIG. 4 is a top plan view of the apparatus as shown in FIG. 3.
Figure 6:
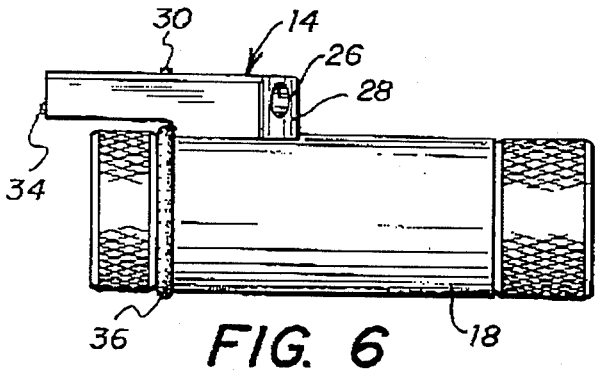
FIG. 6 is right side elevational view of the apparatus shown in FIG. 3.

Referring still to FIG. 3 and additionally to FIGS. 4 and 6, the housing 14 is associated with cylindrical shell 18 in such a way that a laser may be readily installed in the shell and a battery may be replaced as required. O-rings like the one shown directly below the housing and identified by numeral 36 may be utilized if deemed appropriate to seal the shell. While it is not necessary, the housing 14 and the shell 18 in this embodiment are shown as being integrally formed. When made in this manner, an extrusion of 6061 aluminum hardened to T-6 condition makes a particularly efficacious material for the housing 14 and shell 18. The means for holding an auxiliary sighting not necessarily be a cylindrical shell 18 for a laser. In some cases, economy may dictate that a small flashlight be mounted on a revolver rather than a laser, and the holder for such a light will obviously be shaped to complement the light.

Figure 7:
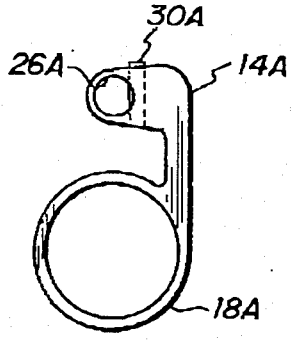
FIG. 7 is a front elevational view of a housing which is used as an alternate embodiment of the invention—for those revolvers which have shrouded ejector rods.

Referring next to FIG. 7, there are some revolvers which are characterized as having shrouded ejector rods, rather than the exposed ejector rod suggested by FIG. 1. Such a revolver is exemplified by the Ruger "Security Six" double-action revolver. In the case of such guns, the principles described thus far are equally applicable—but the configuration of an aluminum extrusion for a suitable housing would naturally have to be different. Instead of the somewhat rectangular shape of the housing 14, the housing 14A in FIG. 7, together with its associated structure 18A for receiving a laser, form a more elaborate shape. While it looks a bit different in this end view, it has a longitudinal bore 26A that is designed to provide a slip fit over the ejector rod of an open cylinder. And it too could advantageously be provided with a resilient body 30A that can be sized to preclude any unwanted metal-to-metal contact that might cause a scratch or leave behind any evidence that a sighting aid had ever been installed on the revolver—once the sighting aid has been removed. So like the original embodiment, this one would be equally effective for mounting an auxiliary sighting aid on a revolver without the need for any screws, bolts, or other mechanical fasteners.

To utilize the apparatus described herein, no professional gunsmithing services are required; a purchaser need only be able to open the cylinder of an appropriate revolver for loading, thereby exposing a cantilevered extension of the cylinder's axle. Usually this extension will be the revolver's ejector rod, and the housing 14 that is to be slipped over the distal end of the rod will have already been sized by the manufacturer to provide a snug fit with that particular ejector rod. Once the housing 14 has been slipped over the end of the ejector rod and pushed down until it stops, the loaded cylinder is ready to be closed. Pushing the cylinder sideways to its stowed position automatically captures the housing between parts of the revolver so that the housing is no longer free to move longitudinally. If there should be too much cushioning material between the housing and the revolver, so that the cylinder will not properly latch to the frame, a small amount of the cushioning can be progressively trimmed away until the housing is firmly captured at the same time that the cylinder latch engages. With a proper amount of cushioning, the housing will not experience any relative movement with respect to the revolver as the revolver is handled, even though no screws or other mechanical fasteners are employed in the mounting process.

If needed, the spot of light that is produced by the mounted laser can be adjusted so that it corresponds with the revolver's sights or the revolver's bore, whichever seems preferable to the shooter. Thereafter, removing the housing 14 from the revolver and then restoring it will cause the housing to return to exactly the same relative position with respect to the revolver. The tight fit of the bore around the ejector rod and the length of the bore—preferably one inch or more—helps ensure a firm and reproducible fit with respect to the revolver. Under normal conditions the repeated removal and installation of a mount and its associated sighting aid will not affect its "zero," so repeated adjustment of the auxiliary sighting aid should not be necessary.

A laser or the like could be carried in a pocket by a policeman and then quickly installed on his service revolver if the situation demanded it. Installation would probably mean that his revolver would have to be out of service for less than five seconds, and most—if not all—of the installation can even be done by feel alone, so that the officer would not be required to take his eyes off of a given area or potential target. The wire that extends between a laser housing and a remote switch will ensure that the housing 14 is correctly oriented as the housing is being slipped onto the ejector rod, so there is no risk of installing the housing with the wrong end forward, even if the installer is not looking at the revolver while working. Five seconds is probably much less time than it takes an average person to load a revolver with ammunition, so installation in the field under adverse conditions—or even in the dark—is a noteworthy feature of this mounting technique.

While the disclosure thus far has focused on the ejector rod as being the preferred anchor of choice for mounting an auxiliary sighting aid onto the frame of a revolver, it should probably be noted that there are some revolvers that do not have classical ejector rods that are used to eject spent cartridges from a revolver. But if these revolvers have cylinder pins or axle pins that project from a revolver frame in a cantilevered fashion, and if such pins can be exposed by opening a cylinder or the like, then it should be possible to practice this invention on such revolvers, too. Those skilled in the art will no doubt be able to appreciate other ways in which the unique housing described herein might be utilized. Too, variations in the exact shape of the disclosed housing and/or bore may also be apparent to those skilled in the art. For example, the bore 26 has been illustrated as a pure, cylindrical bore with continuous walls. But it should be remembered that the bore is merely a feature that is designed to match a cylindrical ejector rod; and if a lack of clearance space adjacent the barrel of a particular revolver should dictate that the bore be drilled where it will "break out" of an adjacent wall, this may cause no problem. As long as the bore has an included angle significantly in excess of 180 degrees, the housing structure will serve to prevent the housing from moving sideways with respect to an ejector rod that it surrounds; hence, the housing will be effectively "captured" as described elsewhere herein.

Having described the preferred embodiment for practicing the invention, as well as pointing out that modifications can be made without departing from the spirit and scope of the appended claims, what is now desired to be protected will be recited.

What is claimed is:

1. A mount for attaching an auxiliary sighting aid to a revolver having an cylinder axle pin, said cylinder axle pin being mounted on the revolver's frame so as to be parallel to the revolver's bore, and the cylinder axle pin being supported by the revolver's frame and being swingably movable between a stowed position and an open position as the cylinder is closed and opened, comprising:

a. a rigid housing having a bore that is sized to snugly receive the cylinder axle pin so that the rigid housing can be firmly supported by the cylinder axle pin and thus be supported by the revolver's frame, and both the size and shape of the housing being such as to preclude interference with the pistol's frame and barrel as the cylinder axle pin is swung from its open position to its stowed position; and b. means for precluding unwanted relative movement between the rigid housing and the revolver's frame when the cylinder axle pin is in its stowed position, whereby an auxiliary sighting means that is attached to the rigid housing will be desirably aligned with the revolver's bore when the cylinder axle pin is stowed.

2. A mount for attaching an auxilliary sightng aid to a revolver having an cylinder axle pin, said cylinder axle pin being mounted on the revolver's frame so as to be parallel to the revolver's bore, and the cylinder axle pin being supported by the revolver's frame and being movable between a stowed position and an open position as the cylinder is closed and opened, comprising:

a. a rigid housing having a bore that is sized to snugly receive the cylinder axle pin so that the rigid housing can be firmly supported by the cylinder axle pin and thus be supported by the revolver's frame; and b. means for precluding unwanted relative movement between the rigid housing and the revolver's frame when the cylinder axle pin is in its stowed position, said means including a resilient member that is put in compression between the rigid housing and the revolver's frame when the cylinder axle pin is moved to its stowed position, whereby an auxiliary sighting means that is attached to the rigid housing will be desirably aligned with the revolver's bore when the cylinder axle pin is stowed.

3. The attaching mount as claimed in claim 2 wherein the resilient member constitutes a plug of rubber-like material.

4. An apparatus having utility in mounting an auxiliary sighting aid on a firearm, the firearm being of the revolver type and having an axle upon which the revolver's cylinder rotates during firing, and said axle having an extension that is selectively movable by swinging between first and second positions adjacent the revolver's barrel, said first position being associated with a closed cylinder and being very close to the revolver's barrel, and said second position being rotated away from the barrel and being associated with an open cylinder, comprising:

a. a rigid housing having a longitudinal bore that is sized and oriented to effect a slip fit with the extension of the cylinder's axle when the cylinder is open and the extension is in its second position, and the housing having a size and shape that precludes any interference with the barrel and frame as the cylinder is swung from its open to its closed position, and the housing having a length that causes the housing to be captured by rigid parts of the revolver when the cylinder is closed and the extension has been moved to its first position; and b. means associated with the rigid housing for holding an auxiliary sighting aid so that it is at least generally parallel to the revolver's barrel when the rigid housing has been slipped over the extension. sliding a part of the rigid mount in a telescopic manner over the revolver's ejector rod while the ejector rod has been temporarily swung outward to a position for loading the cylinder;

b. maintaining the rigid mount on the ejector rod while the ejector rod is being swung back to a position in which the revolver may be fired; and c. attaching an auxiliary sighting aid to said rigid mount.

5. The apparatus as claimed in claim 4 wherein said means for holding an auxiliary sighting aid and the rigid housing are integrally formed.

6. The apparatus as claimed in claim 4 and further including a resilient cushion carried by the rigid housing and protruding outwardly from said housing so as to bear against a rigid part of the revolver when the rigid housing has been moved to its first position.

7. The apparatus as claimed in claim 6 wherein the resilient cushion is made of a rubber-like material having the physical properties of a rubber O-ring.

8. The apparatus as claimed in claim 6 wherein the resilient cushion protrudes from the rigid housing for a distance on the order of 0.030 inch.

9. The apparatus as claimed in claim 6 wherein the resilient cushion has an area of about 0.02 square inch that is brought into contact with a rigid part of the revolver when the rigid housing is moved to its first position.

10. The apparatus as claimed in claim 4 wherein the rigid housing has a frontal surface that is inclined rearwardly so as to create a ramp-like member that will bear against a rigid part of the revolver as the rigid housing is rotated to its first position, whereby the rigid housing will be pushed rearwardly by interaction between the ramp-like member and a rigid part of the revolver as the cylinder is closed.

11. The method of mounting an auxiliary sighting aid on a firearm of the revolver type, and said revolver having a cantilevered ejector rod and a swing-out cylinder, comprising the steps of:

a. securing a rigid mount for an auxiliary sighting aid on the revolver with a slip fit and without the necessity of making any permanent connections to the revolver, said slip fit being accomplished by the step of sliding a part of the rigid mount in a telescopic manner over the revolver's ejector rod while the ejector rod has been temporarily swung outward to a position for loading the cylinder;

b. maintaining the rigid mount on the ejector rod while the ejector rod is being swung back to a position in which the revolver may be fired; and c. attaching an auxiliary sighting aid to said rigid mount.

12. The method as claimed in claim 11 wherein the auxiliary sighting aid is attached to the rigid mount before the rigid mount is secured to the revolver.

13. The method as claimed in claim 11 and including the further step of blocking the rigid housing against longitudinal movement with respect to the ejector rod by the act of swinging the cylinder to its closed and ready-to-fire position.

14. (Rewritten in independent form). The method of mounting an auxiliary sighting aid on a firearm of the revolver type, and said revolver having a cantilevered ejector rod, comprising the steps of:

a. securing a rigid mount for an auxiliary sighting aid on the revolver with a slip fit and without the necessity of making any permanent connections to the revolver, said slip fit being accomplished by the step of sliding a part of the rigid mount in a telescopic manner over the revolver's ejector rod;

b. providing a friction member that is positioned between the rigid mount and the ejector rod, such that removal and installation of the rigid mount requires at least some manual force to be exerted against the resistance of the friction member; and c. attaching an auxiliary sighting aid to said rigid mount.

15. The method of mounting an auxiliary sighting aid on a revolver, said revolver having an ejector rod that is movable between open and stowed positions with respect to the revolver's frame, comprising the steps of:

a. moving the ejector rod to its open position so as to create a significant clearance space around the ejector rod;

b. connecting a rigid housing to the ejector rod while it is in its open position;

c. restoring the ejector rod to its stowed position alongside the revolver's frame after the rigid housing has been connected thereto; and d. mounting an auxiliary sighting aid on the rigid housing, whereby the auxiliary sighting aid can be mounted in a desired relationship with respect to the revolver's barrel by virtue of connecting it to the ejector rod.

16. The method as claimed in claim 15 wherein the mounting of an auxiliary sighting aid is reversible without manipulation of any mechanical screws by sliding the rigid housing off the ejector rod while the ejector rod is in its open position.

17. The method as claimed in claim 15 and including the further step of biasing the rigid housing against any significant movement with respect to the revolver after the rigid housing has been connected to the ejector rod and after the ejector rod has been restored to its stowed position, said biasing being accomplished by inserting a resilient member between any confronting surfaces of the rigid housing and immediately adjacent parts of the revolver.

* * * * *